United States Patent [19]

Matsumoto et al.

[11] 4,044,080

[45] Aug. 23, 1977

[54] CARBURETOR

[75] Inventors: Hiromitsu Matsumoto; Kazuo Uchiyama, both of Hamamatsu, Japan

[73] Assignee: Yamaha Hatsudoki Kabushiki Kaisha, Iwata, Japan

[21] Appl. No.: 696,931

[22] Filed: June 17, 1976

Related U.S. Application Data

[63] Continuation of Ser. No. 536,407, Dec. 26, 1974, abandoned.

[30] Foreign Application Priority Data

Dec. 28, 1973 Japan ..... 49-120

[51] Int. Cl.[2] ..... F02M 29/00

[52] U.S. Cl. ..... 261/44 R; 261/DIG. 55

[58] Field of Search ..... 261/44 R, DIG. 21, DIG. 55

[56] References Cited

U.S. PATENT DOCUMENTS

| | | | |
|---|---|---|---|
| 1,147,644 | 7/1915 | Reichenbach | 261/DIG. 55 |
| 1,305,036 | 5/1919 | Vincent | 261/DIG. 55 |
| 1,356,661 | 10/1920 | Schulz | 261/DIG. 21 |
| 1,625,573 | 4/1927 | Simpson | 261/DIG. 21 |
| 1,688,285 | 10/1928 | Purris et al. | 261/41 B |
| 1,701,600 | 2/1929 | Yeo | 261/44 R |
| 1,793,148 | 2/1931 | Warlay | 261/44 R |
| 3,512,511 | 5/1970 | Rappolt | 123/131 |
| 3,867,487 | 2/1975 | Matsumoto | 261/44 R |

FOREIGN PATENT DOCUMENTS

| | | | |
|---|---|---|---|
| 958,439 | 1/1957 | Germany | 261/DIG. 55 |
| 116,970 | 7/1918 | United Kingdom | 261/DIG. 55 |
| 299,191 | 10/1928 | United Kingdom | 261/44 R |
| 1,385,443 | 2/1975 | United Kingdom | |
| 1,224,256 | 3/1971 | United Kingdom | |
| 1,189,814 | 4/1970 | United Kingdom | |
| 350,802 | 6/1931 | United Kingdom | |
| 212,735 | 3/1924 | United Kingdom | |

*Primary Examiner*—Tim R. Miles
*Attorney, Agent, or Firm*—Donald D. Mon

[57] ABSTRACT

A carburetor comprising catching means for catching fuel deposited on the inner wall of a main air passage in the form of liquid and then flowing downstream therefrom and a passage means for delivering the liquid fuel thus caught to a carburetor throat, wherein the recovered liquid fuel is again ejected into the main air passage through an opening formed at one end of said passage means by negative pressure in the carburetor throat.

11 Claims, 3 Drawing Figures

CARBURETOR

Figure 1:
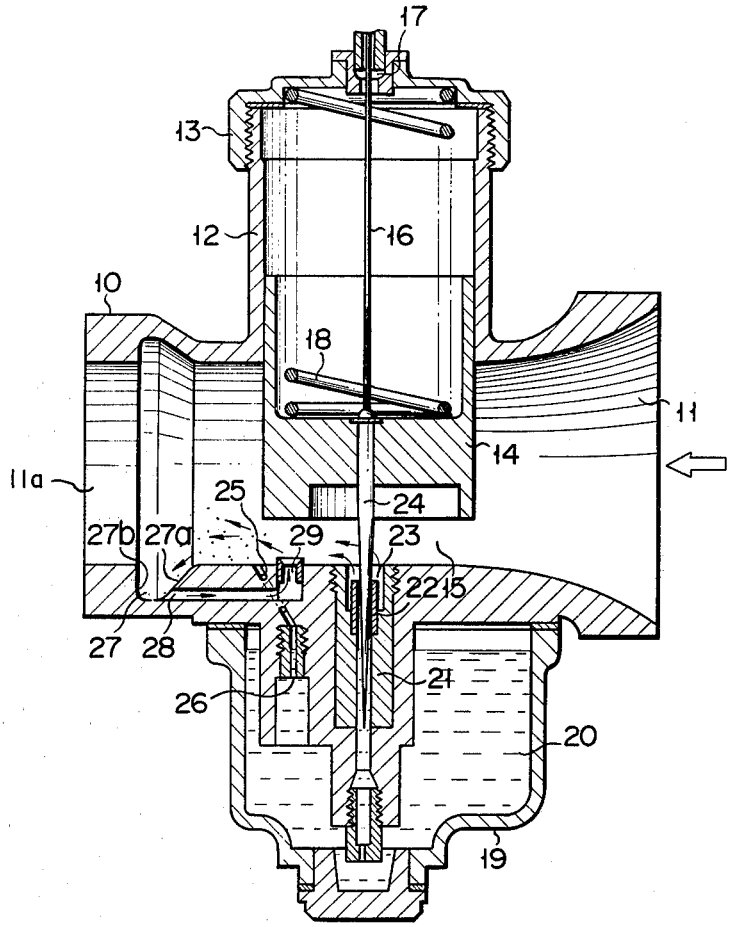

This invention relates to a carburetor used with an internal combustion engine and more particularly to a carburetor provided with means for again atomizing the fuel deposited on the inner wall of a main air passage in the form of liquid.

With prior art carburetors, part of the fuel sprayed from a main nozzle is deposited on the inner wall of the main air passage to be lost from a gaseous mixture. In view of such loss, therefore, it has been considered necessary to enrich the proportion of fuel relative to the air to provide a suitably balanced mixture. When brought into the combustion chamber through an inlet port, the recovered liquefied fuel flowing along the inner wall of the main air passage is subjected to incomplete combustion, resulting in evolution of harmful gases such as CO and HC, and an excessive consumption of fuel. What is worse, the recovered liquefied fuel is irregularly introduced into the combustion chamber in the form of droplets, undesirably rendering the operation of the internal combustion engine unstable. Particularly with an internal combustion engine provided with a plurality of cylinders and a single carburetor, some of the cylinders admit of easy entry of the recovered liquefied fuel, while the others present difficulties in allowing the influx of said fuel, resulting in non-uniform combustion among the cylinders and in consequence an unstable operation of the internal combustion engine.

Known carburetors proposed to eliminate the above-mentioned drawbacks are, for example, those set forth in the British Pat. Nos. 1,151,802 and 1,224,256 which are provided with means for catching fuel deposited on the inner wall of the main air passage in the form of liquid and then flowing downstream therefrom and atomizing said recovered fuel by negative pressure in the proximity of a butterfly-type throttle valve. With these proposed carburetors, slight opening of the throttle valve provides fully large negative pressure, whereas broad opening of said valve substantially suppresses the pressure difference between the fuel catching means and the proximity of the throttle valve. Therefore, atomization of liquefied fuel deposited on the inner wall of the main air passage prominently varies with the degree in which the throttle valve is opened. Particularly when the throttle valve is widely opened, substantially no atomization takes place.

It is accordingly the object of this invention to provide a carburetor capable of again atomizing the liquefied fuel deposited on the inner wall of the main air passage under a stable condition.

A carburetor according to this invention comprises means for catching fuel deposited on the inner wall of the main air passage in the form of liquid and then flowing downstream therefrom and passage means open to a carburetor throat to deliver the recovered liquefied fuel thereto.

The suction negative pressure of the internal combustion engine and the venturi negative pressure are applied to the carburetor throat, which is subject to the highest negative pressure throughout the main air passage. Under this arrangement, the recovered liquefied fuel is unfailingly atomized and ejected into the combustion chamber through the opening of the above-mentioned passage means, thereby attaining a stable operation of the internal combustion engine. Since it is unnecessary to take into account the loss of fuel deposited on the inner wall of the main air passage, the carburetor of this invention can be designed to supply a lean gaseous mixture and in consequence reduce the amount of harmful materials such as CO and HC contained in the exhaust gas. Further the subject carburetor can decrease fuel consumption.

There will now be described a carburetor according to this invention by reference to the appended drawings.

Figure 2:
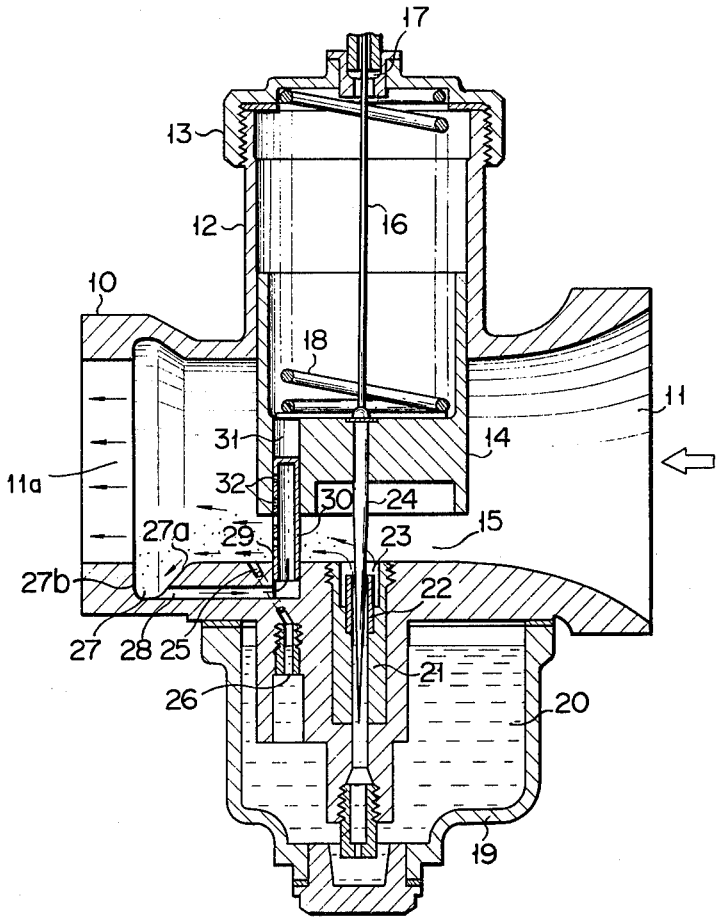
Figure 3:
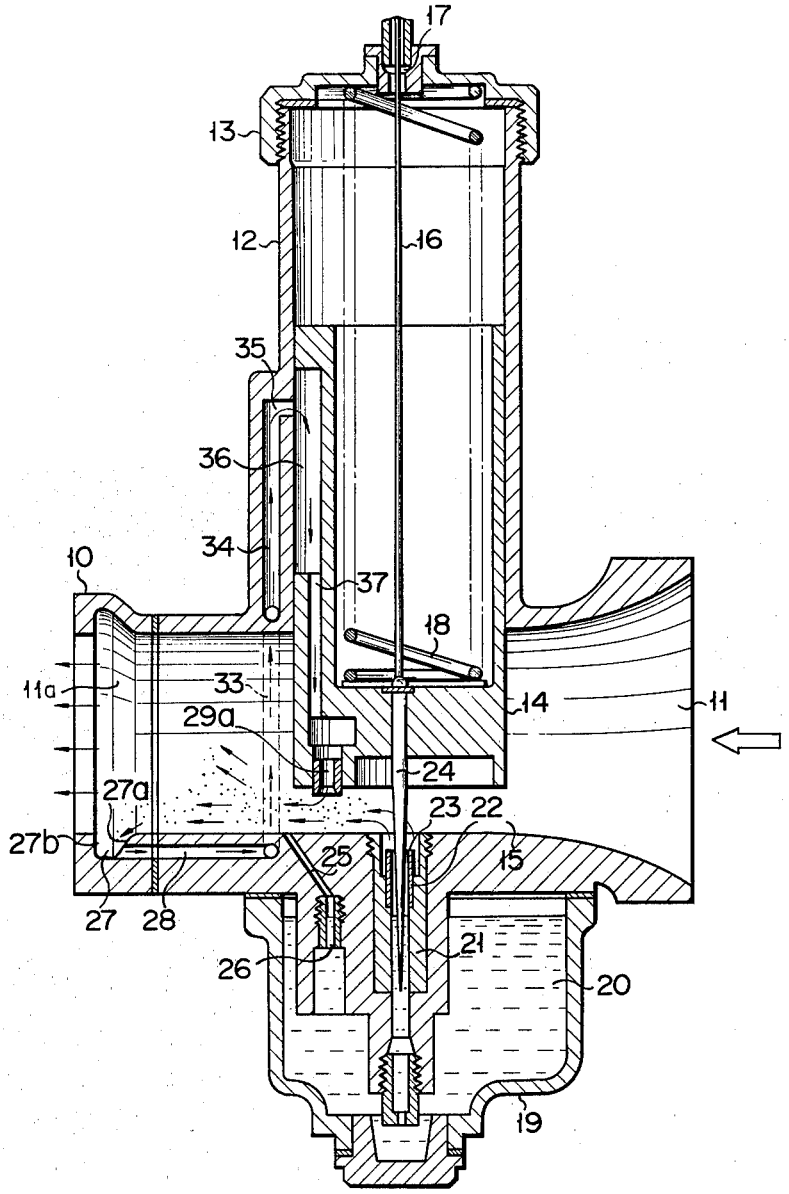

FIG. 1 is a longitudinal sectional view of a carburetor according to an embodiment of the invention, showing the condition of the carburetor when the internal combustion engine is in normal operation; and FIGS. 2 and 3 are similar longitudinal sectional views of carburetors according to the other embodiments of the invention when the internal combustion engine is in normal operation.

Any of the carburetors described in the following examples is designed to supply a leaner gaseous mixture than a stoichiometric air-fuel ratio of about 16 when using gasoline as fuel.

A carburetor according to the embodiment of FIG. 1 is a horizontal draft type which has a casing 10 bored with an upstream horizontal main air passage 11 and a downstream mixture supply passage 11*a*. The main air passage communicates with the atmosphere and tends to approach atmospheric pressure. The mixture supply passage 11*a* communicates with the intake port of air internal combustion engine, and its pressure depends on engine operating conditions and throttle settings. Provided at the top of the casing 10 is a cylindrical section 12 extending at right angles with the horizontal main air passage 11. The lower end of the cylindrical section 12 is opened to the main air passage 11, and the upper end thereof is sealed by a nut plug 13. A throttle valve or piston 14 is fitted into the cylindrical section 12 so as to slide vertically, the lower end of said piston 14 projecting into the main air passage 11. Said piston 14 defines a carburetor throat 15 in the main air passage 11 together with the inner wall thereof. The throat 15 has a smaller cross sectional area than any other part of the main air passage 11 even when the throttle valve is opened widest. This cross-sectional area is adjustable in size.

A pulling wire 16 is fixed at one end to the upper end of the piston 14. The other end of the pulling wire 16 passes through a hole 17 formed in the nut plug 13 to be connected to a throttle lever (not shown). A compression spring 18 is stretched across the upper end of the piston 14 and the lower end of the nut plug 13 normally to urge the piston 14 downward. When the wire 16 is pulled, the piston 14 is lifted against the force of the spring 18 and, when the wire 16 is loosened, is brought down by the spring 18.

The casing 10 is provided at the bottom with a float chamber 19 for holding fuel 20. A main nozzle 21 communicating with the float chamber 19 extends upward in the axial direction of the piston 14, and is fitted with a needle jet 22 at the upper part. The upper opening 23 of the main nozzle 21 communicates with the main air passage 11 right below the piston 14. A jet needle 24 tapered downward is fixed to the lower end of the piston 14, and concentrically inserted into the needle jet 22. The jet needle 24 meters the amount of fuel being ejected into the combustion chamber in cooperation with the needle jet 22 according to the vertical movement of the piston 14.

An idle port 25 is opened to the main air passage 11 downstream of the main nozzle 21. The idle port 25 communicates with the float chamber 19 through a passage 26 and supplies fuel to the main air passage 11 at the time of idling.

An annular groove 27 (sometimes called catching means) extending all along the periphery of the main air passage 11 is formed in the inner wall of the main air passage 11 downstream of the main nozzle 21 and idle port 25 to catch fuel deposited on said inner wall in the form of liquid and then flowing downstream along said inner passage. The upstream wall 27*a* of the groove 27 is gently inclined from the inner wall of the main air passage 11. On the other hand, the downstream wall 27*b* of the groove 27 constitutes a substantially vertical plane relative to the axis of the main air passage 11. One end of a passage 28 (sometimes called return passage means) formed in the casing 10 is opened to the lower end of the groove 27. The other end of said passage 28 is provided with an upward opening port 29 on the extreme downstream side of the carburetor throat 15. Said extreme downstream side is subject to the highest negative pressure throughout the carburetor throat 15.

There will now be described the operation of a carburetor according to the embodiment of FIG. 1. While the internal combustion engine is operated, fuel is sprayed from the opening 23 of the main nozzle 21 toward the engine (to the left side of FIG. 1). While most of the fuel is ejected into the engine cylinder, part of the fuel is deposited on the inner wall of the main air passage 11 and brought back to the form of liquid. The liquefied fuel is conducted along the inner wall of the main air passage 11 to the groove 27 by the force of gas streams running through said passage 11. At this time, the fuel smoothly flows into the groove 27 along its inclined wall 27*a* without being scattered, and is brought to rest by the upright wall 27*b* of said groove 27. The fuel brought into the groove 27 is collected at the bottom and sucked into the passage 28 by the negative pressure of the carburetor throat 15 and again sprayed into the main air passage 11 through the opening 29. As previously mentioned, the throat 15 receives the most negative pressure throughout the main air passage 11, because the suction negative pressure of the internal combustion engine and the throat negative pressure are applied to said section 15, thereby enabling the fuel in the passage 28 to be unfailingly sucked into the main air passage 11.

A carburetor according to the embodiment of FIG. 2 has substantially the same arrangement as that of FIG. 1, excepting that a jet pipe 30 is additionally provided. The jet pipe 30 is fixed to the opening 29, vertically extends in the radial direction of the main air passage 11, and is slidably fitted in airtightness into a corresponding hole 31 bored in the piston 14. The jet pipe 30 communicates with the passage 28 and is closed at the top. The downstream wall of the jet pipe 30 is provided with linearly arranged small holes 32.

The carburetor of FIG. 2 operates in substantially the same manner as that of FIG. 1. It has the advantage of making a very good response to the operation of the internal combustion engine, because more of the small holes 32 are opened as the piston 14 is more lifted at higher output.

With a carburetor according to the embodiment of FIG. 3, the passage 28 extending from the groove 27 is opened to the cylindrical section 12 through passages 33, 34 and an opening 35 formed in the wall of the casing 10. That wall of the piston 14 which faces the opening 35 is provided with a vertically elongate groove 36, which is made so long as to communicate with the opening 35 regardless of the vertical movement of the piston 14. The vertically elongate groove 36 communicates with an opening 29*a* connected to the carburetor throat 15 at the lower end of the piston 14 through a passage 37 bored therein.

While the internal combustion engine is operated, liquefied fuel collected in the groove 27 is ejected into the venturi section 15 through return passage means comprising passages 28, 33, 34, opening 35, groove 36, passage 37, and then through opening 29*a* in turn.

Since, according to the embodiment of FIG. 3, the opening 29*a* is formed in the piston 14 widely apart from the inner wall of the main air passage 11, fuel ejected through the opening 29*a* can be sucked into the engine cylinder substantially without being deposited on the inner wall of the main air passage.

According to the above-mentioned embodiments, the groove ("catching means" ) for collecting liquefied fuel is made annular. However, it is possible to form said groove in a semiannular shape so as to be received only in the lower half of the inner wall of the main air passage 11. Further, the groove 27 may be replaced by an annular rib projecting into the main air passage 11.

What we claim is:

1. In combination: a carburetor having a piston type throttle valve defining a carburetor throat of variable cross-section, said cross-section being reduced so that flow of fluid therethrough generates a reduced pressure therein; an upstream air passage for exposure to atmospheric pressure; a downstream mixture supply passage for connection with an intake port of an internal combustion engine, said carburetor throat interconnecting and being placed immediately between said passages; supply means for delivering fuel to said carburetor throat, catching means downstream from said throat for catching liquefied fuel which has deposited on the inner wall of the mixture supply passage and then flowed downstream; and return passage means for conducting the recovered liquefied fuel from the catching means to the carburetor throat by virtue of a difference in pressure between the pressure in the mixture supply passage at the catching means and the pressure in the carburetor throat, said return passage means having a first opening opening directly into the carburetor throat to return said liquefied fuel thereto, the rate of flow of said liquefied fuel being determined by its availability and by the difference between said pressures.

2. A carburetor according to claim 1; wherein the supply means comprises a main nozzle provided in the carburetor throat and an idle port disposed downstream of the main nozzle.

3. A carburetor according to claim 1, wherein the carburetor is designed to supply a gaseous mixture leaner than a stoichiometric mixture.

4. A carburetor according to claim 1, wherein the carburetor is a horizontal draft type.

5. A carburetor according to claim 4, wherein the first opening is formed in the lower inner wall of the carburetor throat.

6. A carburetor according to claim 4, wherein the first opening is provided with a jet pipe vertically projecting in the radial direction of the carburetor throat and bored with a plurality of small holes open on the downstream side; and the piston type throttle valve has a hole into which the jet pipe is slidably fitted.

7. A carburetor according to claim 4, wherein part of the passage means penetrates the piston type throttle valve; and the first opening communicates with said penetrating part and is disposed at the lower end of the throttle valve.

8. A carburetor according to claim 4, wherein the catching means includes at least one groove formed in the inner wall of the mixture supply passage.

9. A carburetor according to claim 8, wherein the groove takes an annular form extending along the periphery of the mixture supply passage.

10. A carburetor according to claim 9, wherein the return passage means has a second opening formed at the lower end of the annular groove.

11. A carburetor according to claim 9, wherein the annular groove has an upstream wall slightly inclining from the inner wall of the mixture supply passage and a downstream wall disposed perpendicular to the axis of the mixture supply passage.

* * * * *